US010654182B2

(12) United States Patent
Meijer et al.

(10) Patent No.: US 10,654,182 B2
(45) Date of Patent: May 19, 2020

(54) SHAVING HEAD AND SHAVING HEAD ELEMENT WITH HAIR-RECEIVING SPACE

(75) Inventors: Hans Meijer, Amersfoort (NL); Oege Smedinga, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 839 days.

(21) Appl. No.: 13/501,988

(22) PCT Filed: Nov. 4, 2010

(86) PCT No.: PCT/IB2010/055002

§ 371 (c)(1),
(2), (4) Date: Apr. 13, 2012

(87) PCT Pub. No.: WO2011/055323

PCT Pub. Date: May 12, 2011

(65) Prior Publication Data

US 2012/0227266 A1 Sep. 13, 2012

(30) Foreign Application Priority Data

Nov. 9, 2009 (EP) ..... 09175350

(51) Int. Cl.
*B26B 19/14* (2006.01)

(52) U.S. Cl.
CPC ..... *B26B 19/14* (2013.01); *B26B 19/146* (2013.01)

(58) Field of Classification Search
CPC ..... B26B 19/14; B26B 19/141; B26B 19/143; B26B 19/145; B26B 19/146
USPC ..... 30/43.4–43.6, 346.51
See application file for complete search history.

(56) References Cited

U.S. PATENT DOCUMENTS 2,952,909 A * 9/1960 Vaes ..... B26B 19/384 30/346.51
3,399,453 A * 9/1968 Biesma ..... B26B 19/14 30/43.6
4,257,161 A * 3/1981 Bijl ..... B26B 19/145 30/43.6
6,212,776 B1 * 4/2001 Izumi et al. ..... 30/43.4
6,722,038 B2 4/2004 Visman et al.
7,370,420 B2 5/2008 Shimizu
7,530,171 B2 5/2009 Baron et al.
(Continued)

FOREIGN PATENT DOCUMENTS

EP 1724073 A1 11/2006
EP 1854592 A1 11/2007
(Continued)

*Primary Examiner* — Evan H MacFarlane

(57) ABSTRACT

A shaving head has a plurality of shaving elements, each including a base portion having a separate space for receiving cut-off hairs, a cutter member for cutting hair, a drive shaft, a pivot pin connected to the cutter member and detachably coupled to the drive shaft, and a cap with a plurality of openings for letting through hairs to be cut off by the cutter member. The cap is movable with respect to the base portion between a closed position in which the space is closed off and an open position in which cut off hairs can be removed from the space. A support member disposed between the cap and the base is movable between a retaining position in which the cutter member is retained in the cap and a release position in which the cutter member can be removed from the cap.

9 Claims, 5 Drawing Sheets

(56) References Cited

U.S. PATENT DOCUMENTS

| | | | | |
|---|---|---|---|---|
| 8,271,156 | B2 | 9/2012 | Jinno | |
| 2003/0019107 | A1 | 1/2003 | Visman et al. | |
| 2009/0320294 | A1 | 12/2009 | Shimizu | |
| 2009/0320295 | A1 * | 12/2009 | Shimizu | B26B 19/145 30/43.6 |

FOREIGN PATENT DOCUMENTS

| | | | | |
|---|---|---|---|---|
| WO | 2006067710 | A1 | 6/2006 | |
| WO | 2006067713 | A1 | 6/2006 | |
| WO | WO 2008/010139 | * | 1/2008 | B26B 19/14 |
| WO | 2008101039 | A1 | 8/2008 | |
| WO | 2010034175 | A1 | 4/2010 | |

* cited by examiner

SHAVING HEAD AND SHAVING HEAD ELEMENT WITH HAIR-RECEIVING SPACE

FIELD OF THE INVENTION

The invention relates to a shaving head unit comprising at least two shaving elements, each being provided with:

- a separate base portion comprising at least a separate space for receiving cut-off hairs,
- a movably arranged cutter member for cutting off hair,
- a drive shaft accommodated in the base portion for driving the cutter member,
- a pivot pin connected to the cutter member, which pivot pin is detachably coupled to the drive shaft,
- a cap with a plurality of openings for letting through hairs to be cut off by the cutting member and to be received in the space, which cap is movable with respect to its associated base portion independently of the cap of another shaving element between a closed position in which the space is closed off and an opened position in which cut off hairs can be removed from the space, and vice versa.

The invention also relates to a shaver comprising such a shaving head unit.

BACKGROUND OF THE INVENTION

By means of such a shaving head unit, which is known from WO 2008/010139, filed in the name of the current applicant, the cap of a shaving element can be pivoted with respect to the base portion to an opened position in order to be able to remove the cut-off hairs from the space for receiving cut-off hairs. Since each cap can be pivoted independently of the cap of another shaving element, the caps can be opened one by one in order to be able to clean each space thoroughly without the risk that the other shaving element and cutter member thereof get contaminated by the cut-off hairs. In the known shaving head unit, the cutter member is associated with the cap in a manner that when the cap is in its opened position, the cutter member remains in its normal operating position relative to the cap. In this way, it is prevented that the cutter member accidentally drops down when the cap is being opened. The cutter member can be inspected and cleaned by flushing water over the cap and the cutter member, for example. However, it has been found out that the cutter member cannot be cleaned sufficiently, which will lead to a reduction of the shaving performance. Furthermore, in case the cutter member is damaged, the cutter member cannot be replaced; instead the whole shaving head unit needs to be replaced.

SUMMARY OF THE INVENTION

It is an object of the invention to provide a shaving head unit of the kind mentioned in the opening paragraph, wherein the cutter member of a shaving element can be easily removed from the cap and easily replaced.

This object is achieved by means of the shaving head unit according to the invention in that each shaving element comprises a separate support device being movably attached to the cap of the shaving element, wherein when the cap is in its opened position the separate support device is movable between a retaining position in which the cutter member of the shaving element is retained in the cap and a release position in which the cutter member of the shaving element can be removed from the cap and vice versa.

The cutter member is kept inside the cap by means of the support device. To clean or replace the cutter member, the support device is moved with respect to the cap to the release position, after which the cutter member can be taken out of the cap. Since each shaving element is provided with its own support device, one support device can be in its release position, so that a user can take out the cutter member, whilst the other cutter members are, in their retaining position, kept inside their caps by their corresponding support devices. In this manner the cutter members can be removed and cleaned one after another, avoiding the risk that a cutter member is damaged or lost.

An embodiment of the shaving head unit according to the invention is characterized in that the support device comprises an aligning device for aligning the pivot pin of the cutter member with respect to the cap, at least when the cap is in its opened position.

When reconnecting the cap to the base portion, the pivot pin of the cutter member needs to be connected to the drive shaft of the base portion. To ensure that the pivot pin can easily be connected correctly, the pivot pin of the cutter member is pre-aligned with respect to the cap by means of the aligning device of the support device.

Another embodiment of the shaving head unit according to the invention is characterized in that the support device is pivotably coupled to the cap.

In this manner the risk of the support device being lost is avoided. Furthermore, the support device can be moved between its retaining position and released position by simply pivoting the support device. This is convenient for the user. In the case that the support device comprises the aligning device, there is a pre-defined movement of the aligning device with respect to the cap, which simplifies the alignment of the cutter member.

Yet another embodiment of the shaving head unit according to the invention is characterized in that at least one of the support device and the cap comprises a locking member to lock the support device and the cap to each other.

By virtue of the locking member, the risk of the support device being accidentally released from the cap is prevented.

A further embodiment of the shaving head unit according to the invention is characterized in that the whole of the cap, the cutter member and the support device is pivotably coupled to the base portion.

In this manner the pivot pin of the cutter member can easily be attached to the drive shaft, since a user only needs to pivot the cap with the cutter member and its pivot pin with respect to the drive shaft in the base portion.

In the case that the support device comprises the alignment device, the pivot pin is pre-aligned with respect to the cap, whereby the pivot pin will easily be aligned with and coupled to the drive shaft, when the cap is being pivoted towards the base portion. If necessary, a final alignment can be obtained when the pivot pin and the drive shaft are being connected to each other.

Yet another embodiment of the shaving head unit according to the invention is characterized in that the aligning device comprises conical guiding means.

When the conical guiding means are being moved towards the pivot pin, the pivot pin might contact the conical guiding means and, if so, will be displaced towards the axis of the conical guiding means.

Another embodiment of the shaving head unit according to the invention is characterized in that the aligning device comprises a centring ring through which at least one of the pivot pin and the drive shaft will extend when the cap is attached to the base portion.

By means of such a centring ring the pivot pin can easily be aligned.

Yet another embodiment of the shaving head unit according to the invention is characterized in that the aligning device comprises a plurality of spokes extending from the centring ring in a direction towards the cap and away from the axis of the centring ring.

Such spokes provide conical guiding means for the pivot pin. Cut-off hairs can be moved from the cutter member through the spaces between the spokes towards the space in the base portion for collecting the cut-off hairs.

Yet another embodiment of the shaving head unit according to the invention is characterized in that when the pivot pin of the cutter member is coupled to the drive shaft, the cutter member and the pivot pin are free of contact with the support device.

Since there is no contact between the support device and the pivot pin or the cutter member, no noise or wear will occur when the cutter member is being rotated by means of the drive shaft.

BRIEF DESCRIPTION OF THE DRAWINGS

The invention will be explained in more detail with reference to the drawings, in which.

Like parts are indicated by the same reference numbers in the Figures.

DETAILED DESCRIPTION OF EMBODIMENTS

Figure 1:
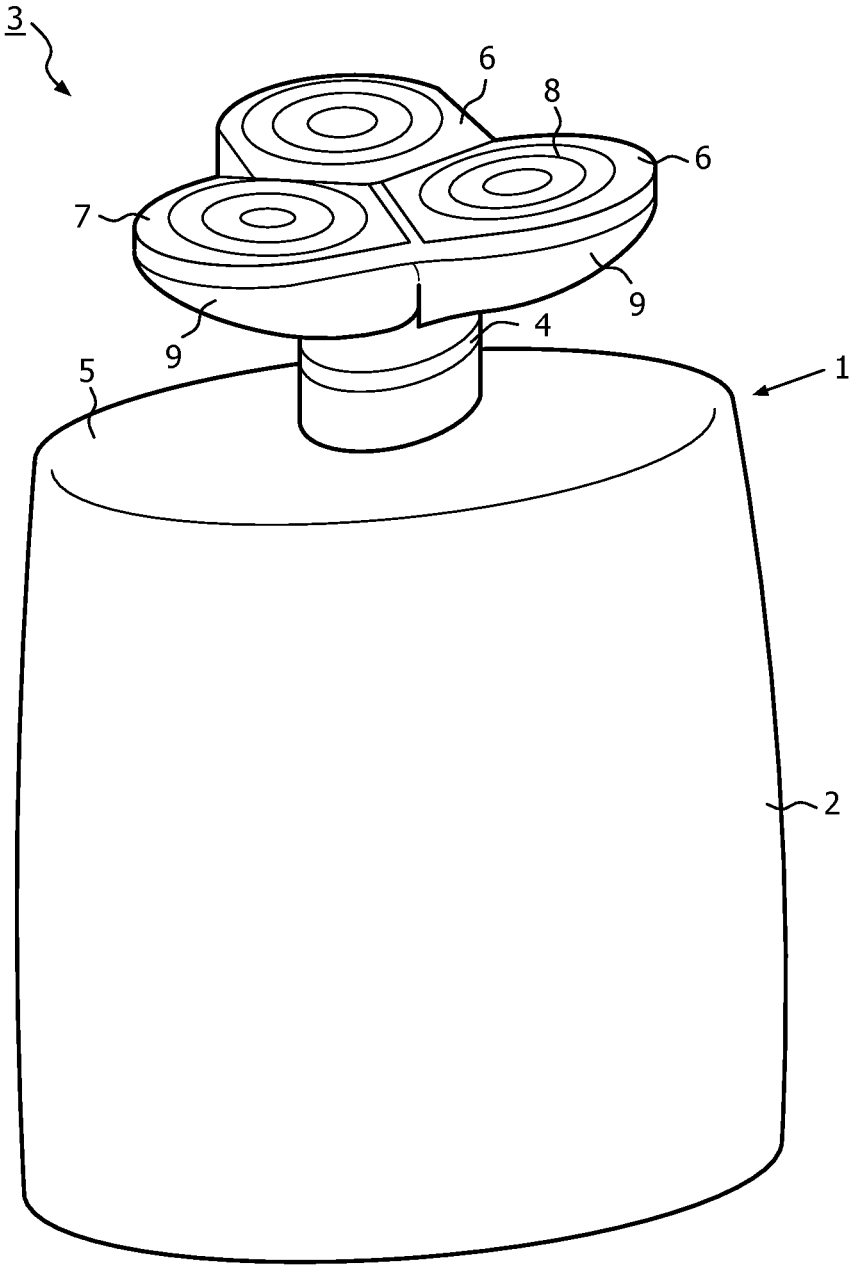
FIG. 1 PRIOR ART
FIG. 1 is a perspective view of an exemplary shaver in which the invention may be employed.

FIG. 1 shows a shaver 1 according to the invention. The shaver 1 comprises a main body 2, which is suitable to be held by a user of the shaver. In FIG. 1, for the sake of simplicity, the main body 2 is only diagrammatically shown in view of the fact that within the scope of the present invention, the main body 2 may have any suitable design. The shaver 1 further comprises a shaving head unit 3, which is suitable to contact an area of skin having hairs to be shaved off and which can suitably be moved with respect to this area. The shaving head unit 3 is connected to the main body 2 through a central shaft member 4, wherein the connection of the shaving head unit 3 to the main body 2 may be detachable. Cross-sectional dimensions of the central shaft member 4 are considerably smaller than the cross-sectional dimensions of the shaving head unit 3, and the shaving head unit 3 is positioned at a certain distance from a top portion of an outer housing 5 of the body portion 2. Consequently, the connection between the main body 2 and the shaving head unit 3 has a slim appearance, wherein the shaving head unit 3 has an elevated position with respect to the body portion 2. Due to this, when a user performs a shaving action by using the shaver 1, he may have a clear side view of the shaving head unit 3.

In FIG. 1, the shaver 1 is shown in a typical orientation, namely an orientation in which a side of the shaver 1 where the shaving head unit 3 is present is the upper side. In the following, when words like "above" and "under" are used, it is assumed that the shaver 1 is in this orientation. In any case, that does not alter the fact that the shaver 1 may be used in any suitable orientation.

In the example shown, the shaving head unit 3 comprises three shaving elements 6, which are arranged in a triangle formation. Within the scope of the present invention, the number of shaving elements 6 may also be two or more than three. For the sake of completeness, it is noted that each of the shaving elements 6 may be movably arranged to a certain extent, so as to facilitate each of them in following a contour of an area of skin to be shaved. For example, the shaving elements 6 may be pivotable with respect to the central shaft member 4, to a limited extent. Each shaving element 6 comprises a cap 7, which is arranged at a top side of the shaving element 6, and which has a plurality of openings 8 for letting through hairs to be shaved off. The cap 7 is pivotably connected to a base portion 9 of the shaving element 6. Right underneath the cap 7, on the inside of the shaving element 6, a cutter member 10 is rotatably arranged. During operation, a central portion of the cutter member 10 is pressed against the cap 7 under spring force.

Figure 7:
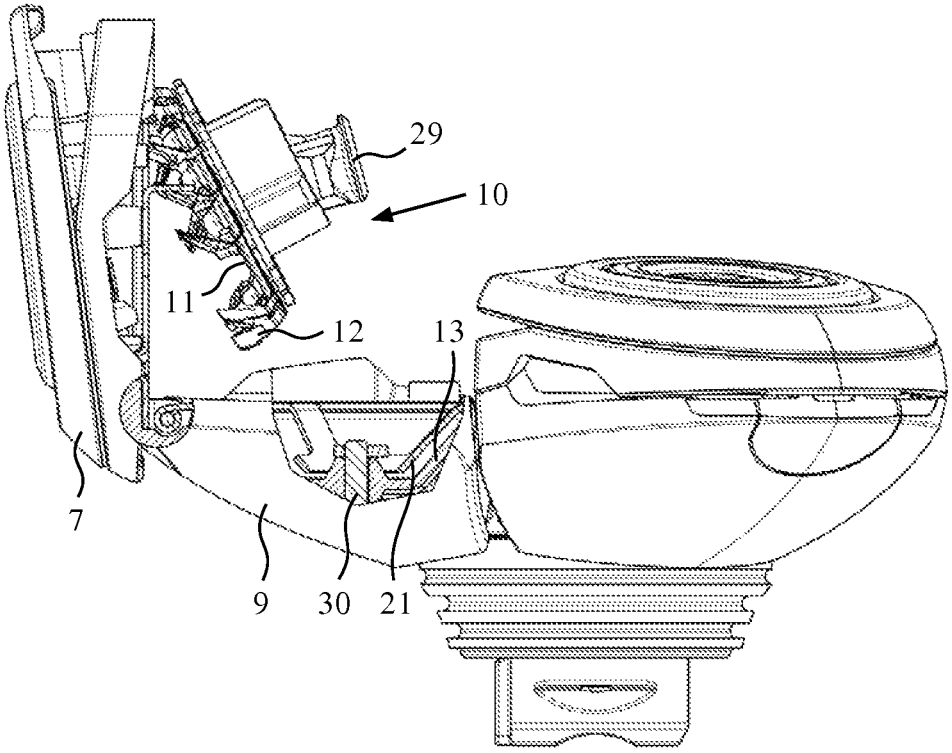
FIG. 7 is a side view as shown in FIG. 4, with the cutter member being removed from the opened cap.

In FIG. 7, the cutter member 10 is shown in more detail. In particular, the cutter member 10 comprises a disc 11 and cutters which are arranged on the disc 11, including hook-shaped cutters 12 which are arranged along the circumference of the disc 11. During operation of the shaver 1, the disc 11 is rotated, and hairs extending through the openings 8 in the cap 7 are cut off when they are hit by a cutter 12. The base portion 9 is provided with a space 13 for receiving the cut-off hairs.

For the purpose of driving the cutter members 10, the shaver 1 comprises at least a motor located in the main body 2 and being connected to drive shafts 30 located inside the base portions 9 of the shaving elements 6.

The shaver 1 as described above is known per se and more fully described in WO 2008/010139 of applicant.

Figure 8:
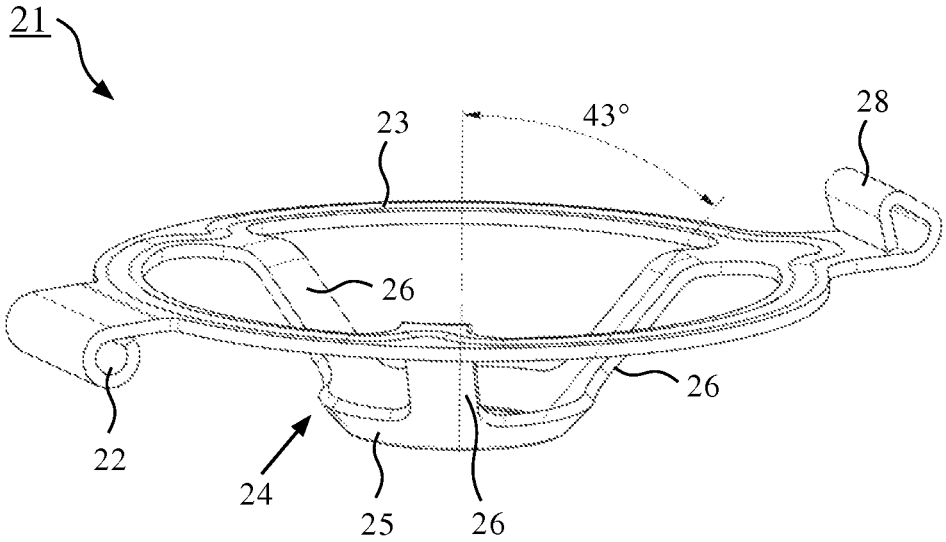
FIG. 8 is a side view of the support device.

The shaving head unit 3 according to the invention differs from the known shaving head unit in that each shaving element 6 comprises a support device 21 pivotably connected to the cap 7 at a pivot axis 22 and located between the cap 7 and the base portion 9. The support device 21 itself is shown in FIG. 8. The support device 21 comprises a ring-shaped element 23 and an alignment device 24. The alignment device 24 is provided with a centring ring 25 and three spokes 26 extending from the centring ring 25 towards the cap 7 and away from the axis 27 of the centring ring 25. The spokes 26 are connected to the ring shaped element 23 on a side remote from the centring ring 25. Since the diameter of the ring-shaped element 23 is larger than the diameter of the centring ring 25, the spokes 26 are arranged in a conical orientation. When using the shaver 1, cut off hairs are moved through the spaces between the spokes 26 into the space 13 in the base portion 9. The support device 21 is provided with a locking member 28 which can be locked to the cap 7.

Figure 2:
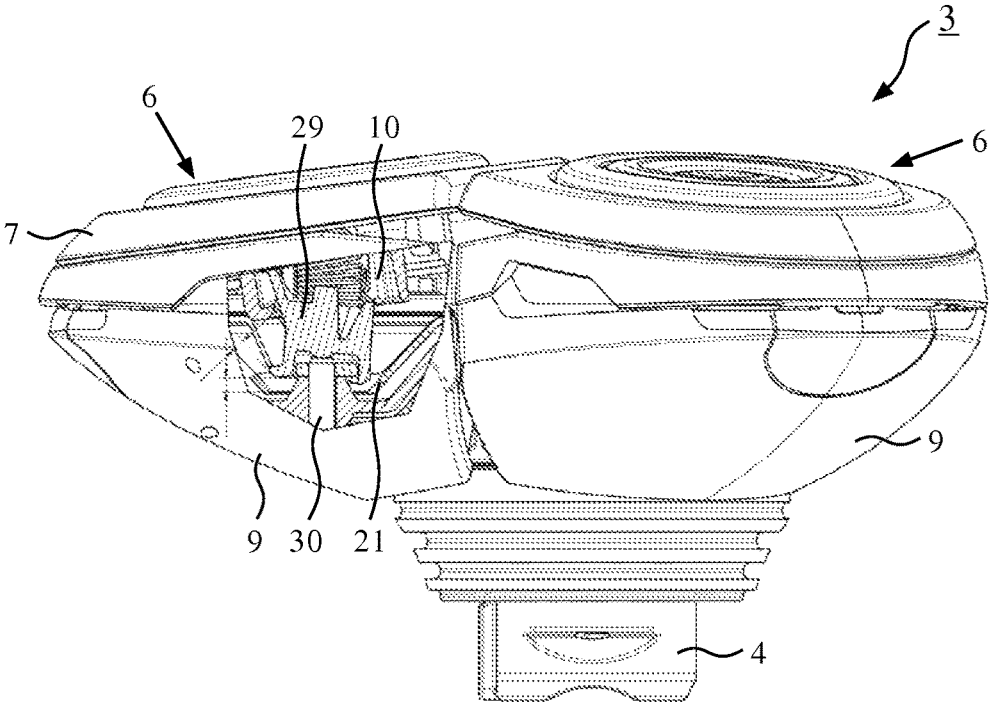
FIG. 2 is a side view of a shaving head unit according to the invention, partly in cross section, with all the caps in their closed position.

In the position as shown in FIG. 2, the caps 7 of all shaving elements 6 are in their closed position, whereby all three separate spaces 13 for receiving cut-off hairs are closed. As shown by the shaving element 6 on the left side of the shaving head unit 3, a driving shaft 29 of the cutter member 10 is connected to a drive shaft 30 located in the base portion 9. The driving shaft 29 of the cutter member 10 is slightly lifted upwards by the drive shaft 30 with respect to the support device 21, so that there is no contact between the support device 21 and the rotating cutter member 10 when the shaver 1 is in operation.

Figure 3:
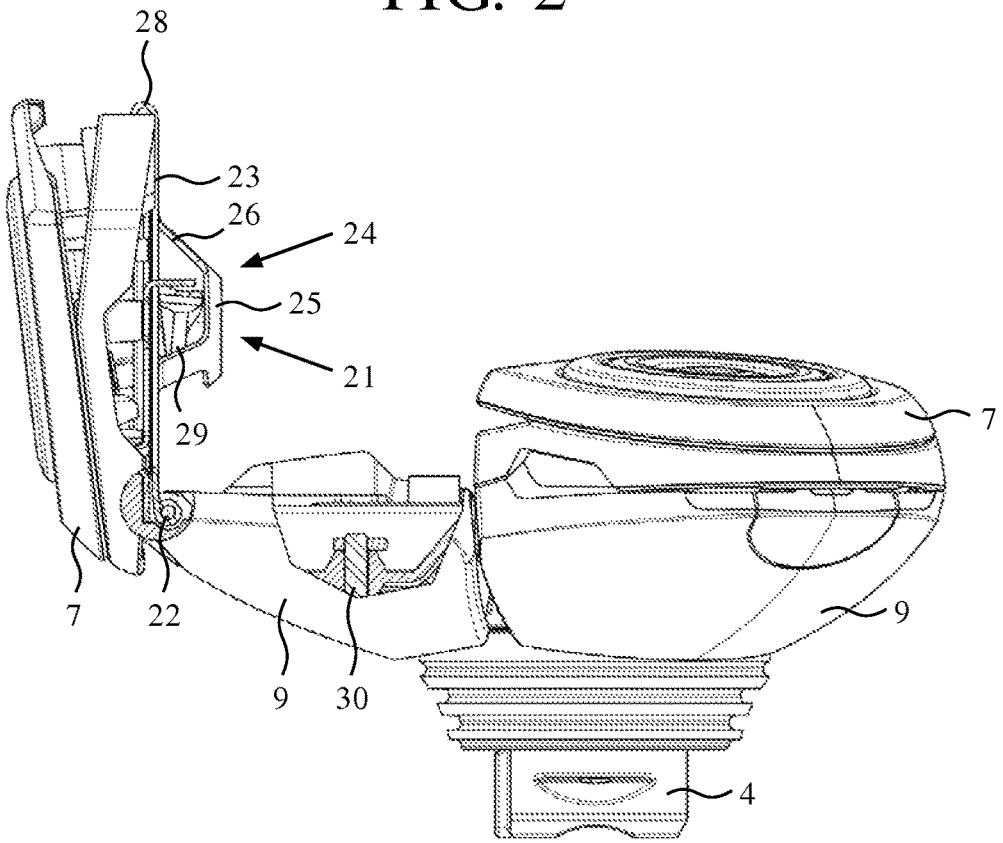
FIG. 3 is a side view of a part of the shaving head unit as shown in FIG. 2, with one cap in an opened position and its support device in its retaining position.

In the position as shown in FIG. 3, the cap 7 of the left shaving element 6 is pivoted away from the base portion 9 to an opened position. The pivot pin 29 of the cutter member 10 is thereby disconnected from the drive shaft 30 of the base portion 9. The support device 21 is locked to the cap 7 by means of the locking member 28 and is in its retaining position, and the centring ring 25 holds the cutter member 10 inside the cap 7 and prevents it from falling out of the cap 7. The cutter member 10 may be biased against the cap 7 by means of a spring.

In the position as shown in FIG. 3, the user can remove the cut off hairs from the space 13 in the base portion 9.

Figure 4:
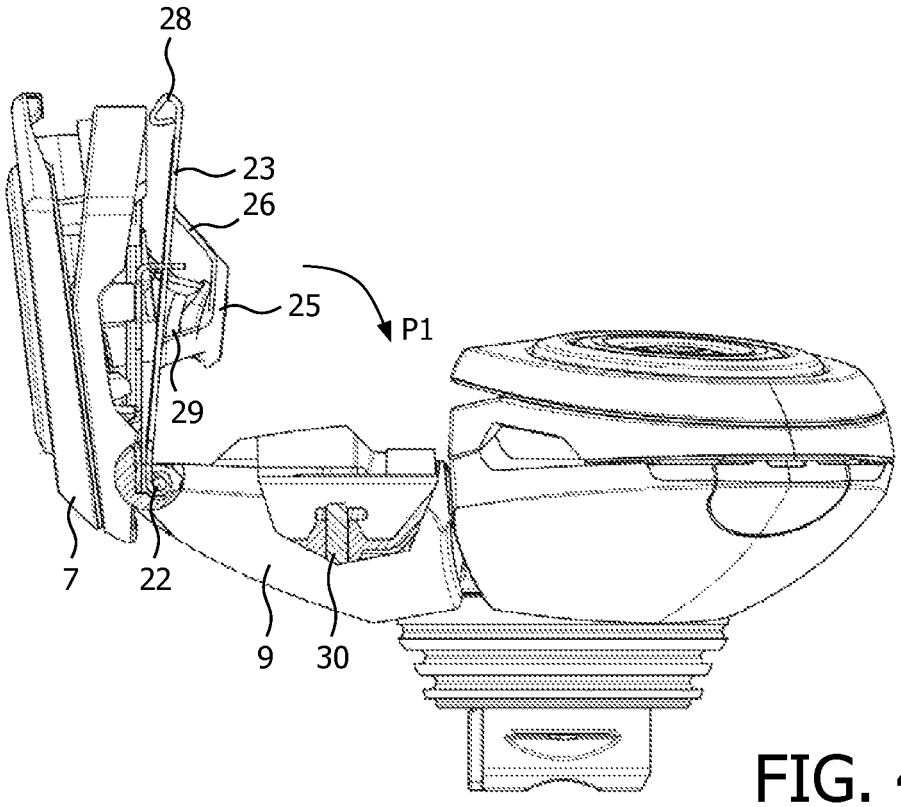
FIG. 4 is a side view of the shaving head unit as shown in FIG. 2, with the support device unlocked from the opened cap.
Figure 5:
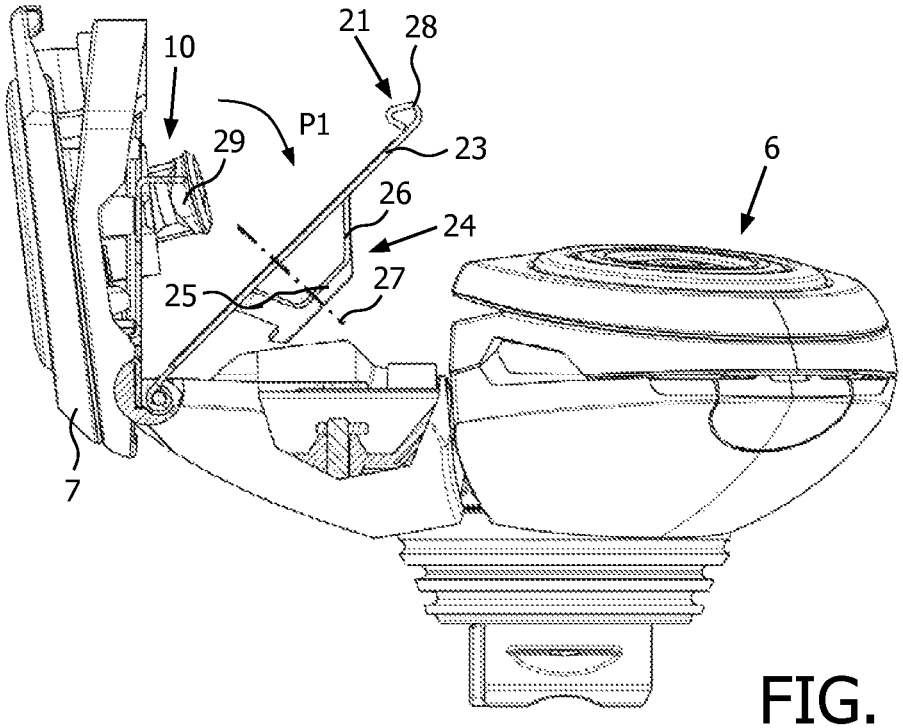
FIGS. 5 and 6 are a side view and a perspective view of the shaving head unit as shown in FIG. 3, with the support device being released from the opened cap.
Figure 6:
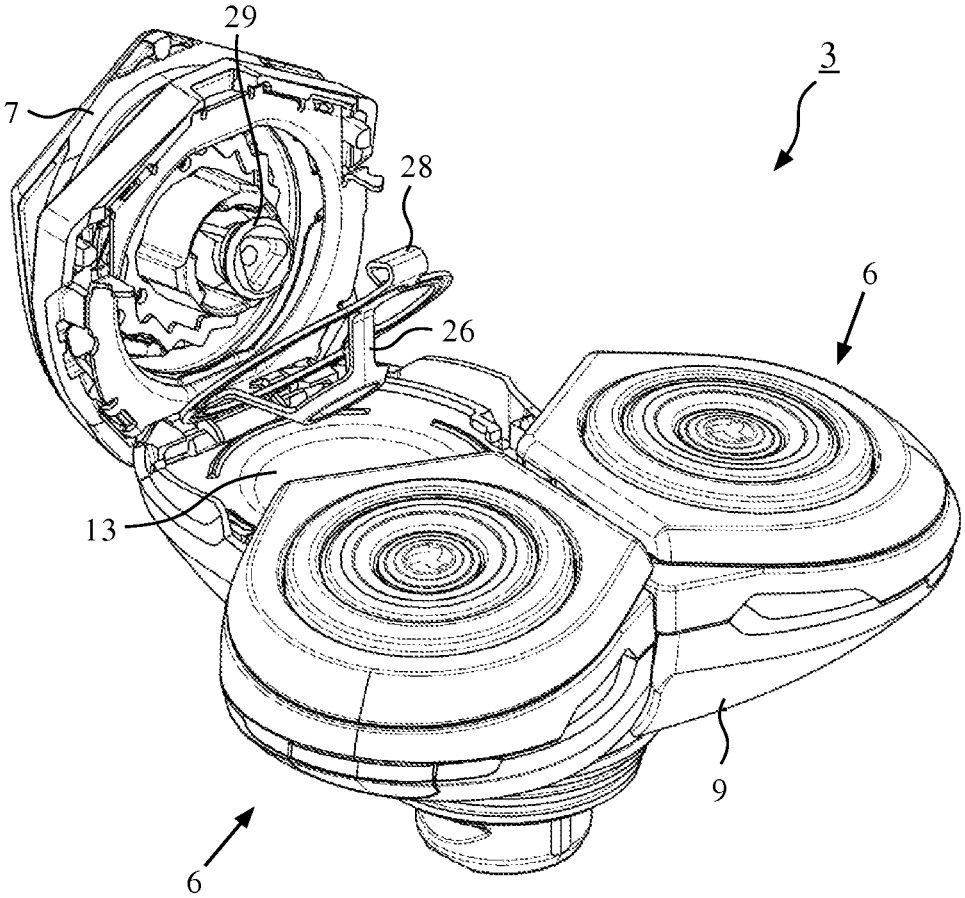

If a user wants to clean the cutter member 10 thoroughly, he unlocks the locking member 28 from the cap 7 and pivots the support device 21 in a direction as indicted by arrow P1, via a position as shown in FIG. 4, to the release position as shown in FIGS. 5 and 6. The support device 21 may also be pivoted further to a release position in which the support device 21 is located inside the space 13 of the base portion 9. In the release position as shown in FIG. 7, the user can remove the cutter member 10 without being hindered by the support device 21. The cutter members 10 of the other shaving elements 6 are still located in their caps 7, so there will be no risk of the user hurting himself by contacting the other cutter members 10 or no risk of these cutter members 10 falling out of the shaver 1.

After cleaning or replacing the cutter member 10, the user puts the cutter member 10 back inside the cap 7. The cutter member 10 is freely movable with respect to the cap 7, and the axis of the pivot pin 29 may extend at a relatively large angle with respect to the axis of the cap 7. The user will move the support device 21 towards the cap 7 in a direction opposite to the direction indicated by arrow P1. If a spoke 26 of the alignment device 24 will thereby contact the pivot pin 29, the pivot pin 29 will be swivelled towards the centre of the alignment device 24. When the support device 21 is locked again to the cap 7, as is shown in FIG. 3, the pivot pin 29 of the cutter member 10 is pre-aligned with respect to the axis 27 of the alignment device 24. Depending on the dimensions of the pivot pin 29 and the alignment device 24, the axis of the pivot pin 29 may always be fully aligned with respect to the axis 27 or the pivot pin 29 may still slightly swivel with respect to the alignment device 24 through a relatively small angle which does not hinder the coupling of the pivot pin 29 to the drive shaft 30.

The user will close the cap 7 by pivoting it towards the base portion 9. Due to the pre-aligned pivot pin 29, it will be automatically coupled with the drive shaft 30 in the base portion 9. See FIG. 2.

It is also possible that the support device 21 is not pivotably connected to the cap 7, but can be completely removed therefrom.

It is also possible that the cap 7 comprises two parts, a first part being pivotably connected to the base portion 9 and a second part being centrally located in the first part and being able to swivel with respect to the first part. The second part is provided with the openings 8, and the cutter member 10 is located against the second part.

It is also possible to provide the alignment device in the space of the base portion. The alignment devices are preferably provided with conical guiding means, since such a conical guiding means makes it possible to slowly but certainly move the cutter element towards the desired pre-aligned position.

The invention claimed is:

1. A shaving head comprising at least first and second shaving elements, each of said shaving elements including:

a. a cap having a plurality of openings for receiving hairs to be cut off;

b. a cutter member connected to a pivot pin and including a plurality of cutters arranged for cutting off hairs extending through the openings of the cap when said cutter member is rotated around an axis of said pivot pin;

c. a base portion including a drive shaft for coupling to the pivot pin, the drive shaft arranged to rotatably drive the cutter member, the cap being pivotably connected to the base portion to enable movement of the cap to a closed position in which the pivot pin is coupled to the drive shaft and in which the cap retains cut off hairs within a hair-receiving space of the shaving element and to further enable movement of the cap to an open position in which the cutter member and cut-off hairs can be removed from the shaving element; and a support member disposed so as to be pivotably movable between the cap and the base portion, while remaining attached to the shaving head, and including a latch member for detachably latching the support member to the cap, said support member comprising an annular shaped element and an alignment device, the alignment device provided with a centering ring and three spokes extending from the centering ring towards the annular shaped element and away from a central axis of the support member, wherein a diameter of the annular shaped element is larger than a diameter of the centering ring, and wherein the three spokes are arranged in a conical orientation, said support member further being configured to retain the cutter member in the cap when in a latched position and to removably hold the cutter member in the shaving head when in an unlatched position;

said support member having at least one opening positioned for facilitating passing of the cut-off hairs into the hair-receiving space; and said alignment device shaped for automatically positioning the pivot pin to align with the drive shaft when the support member is in the latched position and the cap is pivoted from the open position to the closed position, and wherein the alignment device of the support member is arranged to pre-align the pivot pin with respect to the drive shaft.

2. A shaving head according to claim 1, where the alignment device is receivable in a space in the base portion.

3. A shaving head according to claim 1 where the support member is pivotably coupled to the cap.

4. A shaving head according to claim 1 where the latch member comprises an end portion of the support member shaped for latching said support member to the cap.

5. A shaving head according to claim 1 where each of the cap and the support member is pivotably coupled to the base portion.

6. A shaving head according to claim 1 where coupling of the pivot pin to the drive shaft urges the cutter member free from contact with the support member.

7. A shaving head according to claim 1 where at least one of the pivot pin and the drive shaft extends through the centering ring of the support member when the cap is in the closed position.

8. A shaver including a shaving head, the shaving head comprising at least first and second shaving elements, each of said shaving elements including:

a. a cap having a plurality of openings for receiving hairs to be cut off;

b. a cutter member connected to a pivot pin and including a plurality of cutters arranged for cutting off hafts extending through the openings of the cap when said cutter member is rotated around an axis of said pivot pin;

c. a base portion including a drive shaft for coupling to the pivot pin, the drive shaft arranged to rotatably drive the cutter member, the cap being pivotably connected to the base portion to enable movement of the cap to a closed position in which the pivot pin is coupled to the drive shaft and in which the cap retains cut off hairs within a hair-receiving space of the shaving element and to further enable movement of the cap to an open position in which the cutter member and cut-off hairs can be removed from the shaving element; and d. a support member disposed so as to be pivotably movable between the cap and the base portion, while remaining attached to the shaving head, and including a latch member for detachably latching the support member to the cap, said support member comprising an annular shaped element and an alignment device, the alignment device provided with a centering ring and three spokes extending from the centering ring towards the annular shaped element and away from a central axis of the support member, wherein a diameter of the annular shaped element is larger than a diameter of the centering ring, and wherein the three spokes are arranged in a conical orientation, said support member further being configured to retain the cutter member in the cap when in a latched position and to removably hold the cutter member in the shaving head when in an unlatched position;

said support member having at least one opening positioned for facilitating passing of the cut-off hairs into the hair-receiving space; and said alignment device shaped for automatically positioning the pivot pin to align with the drive shaft when the support member is in the latched position and the cap is pivoted from the open position to the closed position, and wherein the alignment device of the support member is arranged to pre-align the pivot pin with respect to the drive shaft.

9. A shaver according to claim 8, where the alignment device is receivable in a space of the base portion.

* * * * *